US005795188A

United States Patent [19]

Harwath

[11] Patent Number: 5,795,188

[45] Date of Patent: Aug. 18, 1998

[54] CONNECTOR KIT FOR A COAXIAL CABLE, METHOD OF ATTACHMENT AND THE RESULTING ASSEMBLY

[75] Inventor: Frank A. Harwath, Downers Grove, Ill.

[73] Assignee: Andrew Corporation, Orland Park, Ill.

[21] Appl. No.: 623,227

[22] Filed: Mar. 28, 1996

[51] Int. Cl.[6] ..... H01R 9/07

[52] U.S. Cl. ..... 439/583; 439/583

[58] Field of Search ..... 439/578, 583, 439/584, 585, 840, 841

[56] References Cited

U.S. PATENT DOCUMENTS

| | | | |
|---|---|---|---|
| 3,199,061 | 8/1965 | Johnson et al. | 439/578 |
| 3,291,895 | 12/1966 | Van Dyke | 439/578 |
| 3,678,446 | 7/1972 | Siebelist | 439/583 |
| 4,046,451 | 9/1977 | Juds et al. . | |
| 4,718,864 | 1/1988 | Flanagan | 439/578 |
| 4,824,400 | 4/1989 | Spinner | 439/578 |
| 5,137,470 | 8/1992 | Doles . | |
| 5,154,636 | 10/1992 | Vaccaro et al. . | |
| 5,167,532 | 12/1992 | Bruno et al. | 439/578 |
| 5,167,533 | 12/1992 | Rauwolf | 439/583 |
| 5,284,449 | 2/1994 | Vaccaro | 439/583 |
| 5,518,420 | 5/1996 | Pitschi | 439/578 |

FOREIGN PATENT DOCUMENTS

| | | | |
|---|---|---|---|
| 1490421 | 11/1977 | United Kingdom | 439/583 |
| 2277207 | 3/1994 | United Kingdom . | |

*Primary Examiner*—Gary F. Paumen
*Assistant Examiner*—Tho D. Ta
*Attorney, Agent, or Firm*—Arnold, White & Durkee

[57] ABSTRACT

A connector 20 assembly comprises a coaxial cable 22 having an inner conductor 27 and a dielectric 29 between the outer conductor 25 and the inner conductor 27. The coaxial cable 22 has one end defined by a cross-sectional perpendicular to the longitudinal axis of the coaxial cable 22 and intersecting the outer conductor 25 at or inward of the apex of a crest and forming an annular flared end portion 31. A clamping member has a contact surface in contact with the inside surface 33 of the flared end portion 31 of the outer conductor 25, an expandable-retractable clamping ring in the valley adjacent to the flared end portion 31 and an attachment holding the annular wedging surface pressed against the clamping ring and the clamping ring wedged against the outside surface of the flared end portion 31 of the outer conductor 25 to provide electrical contact between the contact surface and the inside surface 33 of the flared end portion 31.

56 Claims, 4 Drawing Sheets

FIG. 9
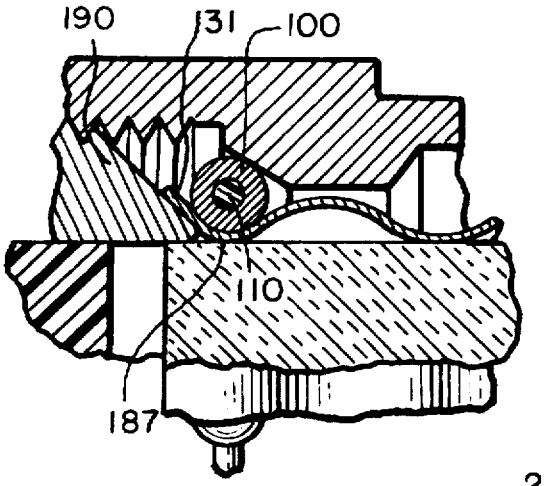
FIG. 10
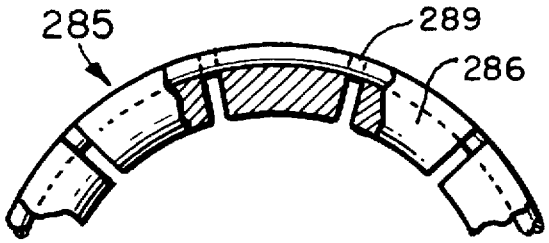
FIG. 11
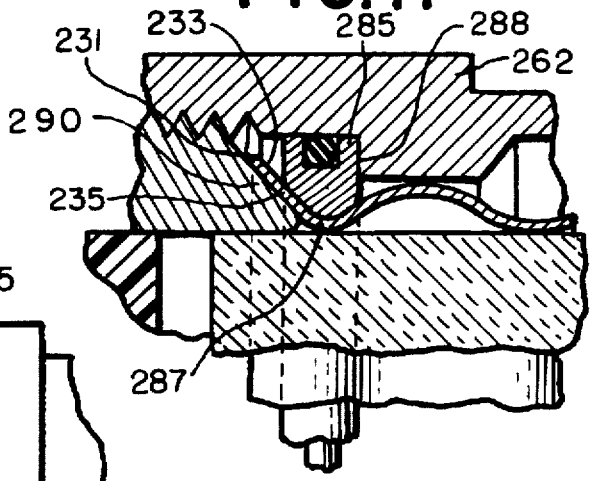
FIG. 12
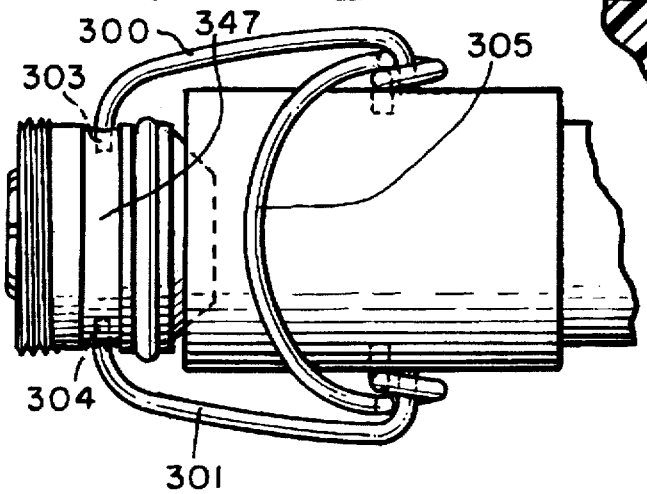
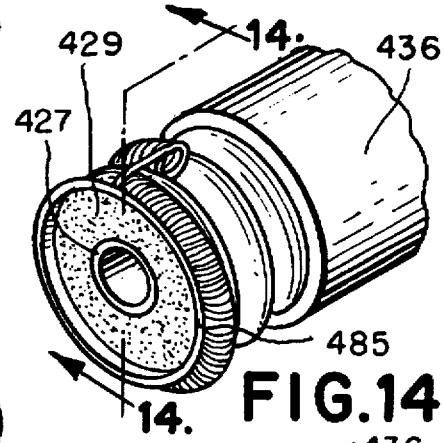
FIG. 14
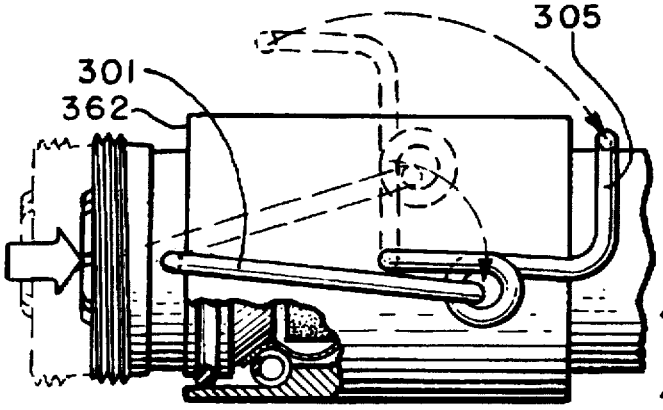
FIG. 13
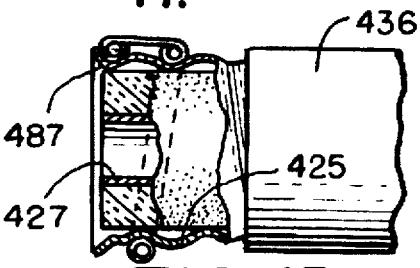
FIG. 15

FIG. 16
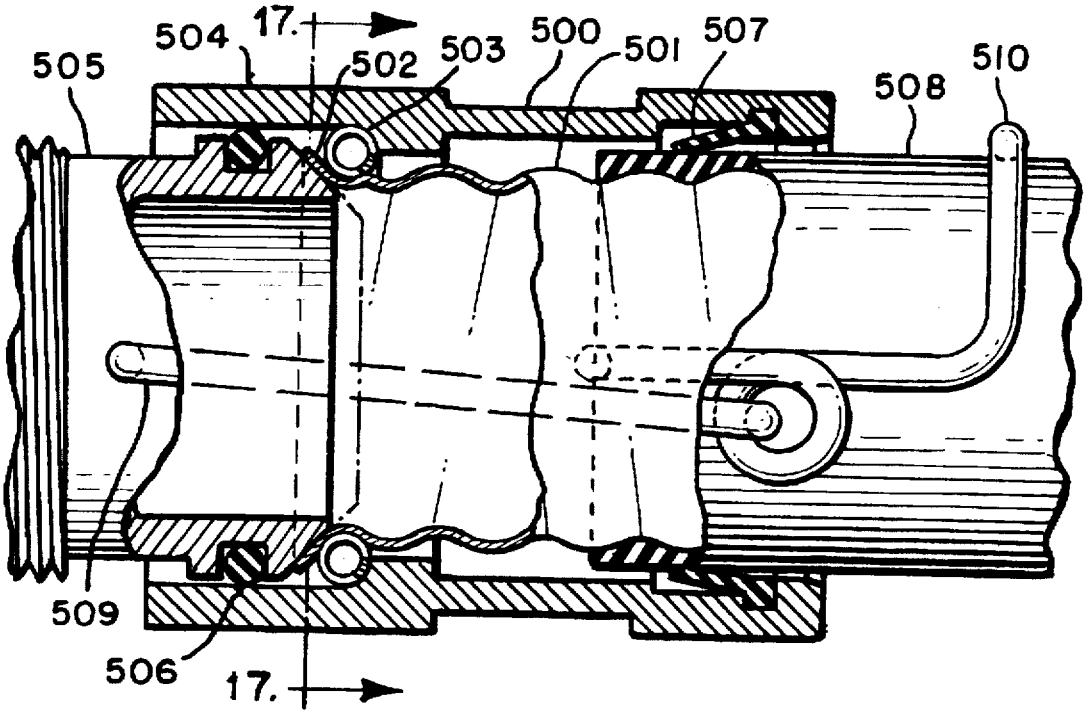
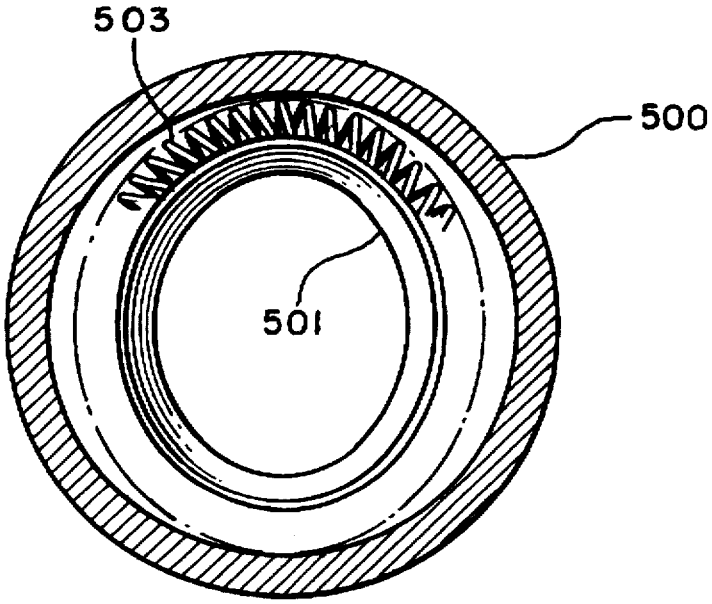
FIG. 17

CONNECTOR KIT FOR A COAXIAL CABLE, METHOD OF ATTACHMENT AND THE RESULTING ASSEMBLY

FIELD OF THE INVENTION

The present invention relates generally to connectors for corrugated coaxial cables. More particularly, it relates to improved coaxial cable connector kits, to methods of attaching connectors to coaxial cables having corrugated outer conductors, and to the resulting assemblies.

BACKGROUND OF THE INVENTION

Connectors for coaxial cables have been used throughout the semi-flexible coaxial cable industry for a number of years. A variety of coaxial cable connectors has been described in issued patents. For example, Rauwolf U.S. Pat. No. 5,167,533 describes a connector for coaxial cables having hollow inner conductors. Vaccaro et al. U.S. Pat. No. 5,154,636 describes a connector for coaxial cables having helically corrugated outer conductors. Doles U.S. Pat. No. 5,137,470 describes a connector for coaxial cables having hollow and helically corrugated inner conductors. Juds et al. U.S. Pat. No. 4,046,451 describes a connector for coaxial cables having angularly corrugated outer conductors and plain cylindrical inner conductors. Van Dyke U.S. Pat. No. 3,291,895 describes a connector for cables having helically corrugated outer conductors and hollow, helically corrugated inner conductors. A connector for a coaxial cable having a helically corrugated outer conductor and a hollow, plain cylindrical inner conductor is described in Johnson et al. U.S. Pat. No. 3,199,061.

A connector for coaxial cables with a helically or annularly corrugated outer conductor is described in Pitschi U.K. Patent No. 2,277,207. The connectors disclosed in the Pitschi patent include sleeves which fit around the corrugated outer conductor to improve the electrical contact between the corrugated outer conductor of the electrical coaxial cable and the connector. As shown in FIGS. 10 and 11 of the Pitschi patent, the sleeves 11 and 12 have a plurality of axial slits 115, 116 which are said to impart to the sleeves a high degree of radial elasticity. The sleeves disclosed in the Pitschi patent have to be custom made for these connectors and they are cumbersome to install.

The present invention overcomes disadvantages inherent in the prior art connectors, methods of attachment and in the resulting assemblies.

Thus, one object of the present invention is to provide an improved coaxial cable connector or a connector kit, which is easy to install onto a coaxial cable having a corrugated outer conductor.

Another object of the present invention is to provide an improved connector or a connector kit which can be quickly and efficiently installed on the end of a corrugated coaxial cable using only basic tools.

Yet another object of the invention is to provide an improved connector or a connector kit which can be efficiently and economically manufactured.

Still another object of this invention is to provide an improved method of attaching a connector to a coaxial cable so that good electrical contact is maintained between the connector and the cable over a long operating life.

A still further object of the present invention is to provide an improved connector assembly which maintains good electrical contact even when subjected to bending and twisting.

Still another object of the present invention is to provide a connector member for an inner conductor which is easy to insert into a hollow inner conductor of a coaxial cable and whose dielectric constant can be adjusted as to match the impedance of the connector to the impedance of the coaxial cable at the frequencies of interest.

A still further object of the present invention is to provide a connector member for a hollow inner conductor, whose dielectric value can be easily and efficiently set or adjusted.

Still another object of the present invention is to provide a connector member for a hollow inner conductor, which is inexpensively manufactured.

A still further object of the present invention is to provide a connector member for a hollow conductor, which can be inserted into the hollow conductor and precisely located in the longitudinal direction without the use of installation tools.

Another object of the present invention is to provide a connector which includes an inexpensive and efficient means for sealing the contact area from moisture and particulates.

A still further object of the invention is to provide a connector member for an inner conductor which is inexpensive to manufacture.

Other objects and advantages of the invention will be apparent to those skilled in the art upon studying this specification and the accompanying drawings.

SUMMARY OF THE INVENTION

In accordance with one aspect of the present invention, a connector assembly includes a expandable-retractable clamping ring (such as a garter spring). The clamping ring expands sufficiently to pass over a flared end portion of a coaxial cable and contracts or is retracted to fit in a corrugation valley which is adjacent or near to the end of a coaxial cable. The end surface of the coaxial cable intersects a crest of a corrugation at or inward of its apex to form a flared end portion. Alternatively, the entire endmost corrugation can be crushed to form an end surface rather than flaring. The clamping ring is mechanically wedged between an annular wedging surface of the housing and the outside surface of the flared end portion. The annular wedging surface presses the ring against the outer surface of the flared end portion so as to provide a uniform long lasting electrical contact between the annular contact surface of a clamping member and the inside surface of the flared end portion. The resulting contact is not easily disrupted by bending or twisting of the coaxial cable.

In accordance with another aspect of the present invention, a method of installing a connector to a coaxial cable with a corrugated outside conductor includes a step of cutting the cable to intersect the outer conductor corrugation crest at or inward of its apex to produce a flared end portion. A front housing is inserted over and moved past the flared end portion. Next, an expandable-retractable ring is placed in a corrugation valley adjacent to the flared end portion. Then, an annular contact surface on a clamping member is placed against the inside surface of the flared end portion. The clamping member and the housing are then brought toward each other until the clamping ring is wedged against the outer surface of the flared end by an annular wedging surface of a housing to achieve electrical contact between the annular contact surface and the inside surface of the flared end portion of the outer conductor of the coaxial cable. The resulting electrical contact is uniform, stable and not readily interrupted by bending or twisting of the cable.

In accordance with another aspect of the present invention, the expandable retractable ring is a garter spring, and in particular a steel garter spring.

In accordance with a further aspect of the present invention, an insert member for connecting the hollow inner conductor of the coaxial cable to a corresponding fitting includes at one end a tubular member adapted to engage the inside wall of the hollow inner conductor. The tubular member has a plurality of longitudinal slits to facilitate insertion of the tubular member into the hollow inner conductor and has a locator ledge to permit precise longitudinal placement of the insert member. The insert member includes on the other end a tapered end section with a plurality of longitudinal slits to facilitate entry thereof into a corresponding mating connector fitting. The taper is made by machining the outside and the inside of the tapered end section. Each of the longitudinal slits have substantially uniform widths along their lengths.

In accordance with yet another aspect of the present invention, an insert member for connecting the inner conductor of the coaxial cable to a corresponding fitting includes a plastic, preferably cylindrical, member with longitudinal bores therethrough to adjust its dielectric constant so as to match the impedance of the connector to the impedance of the coaxial cable at the frequencies of interest.

In accordance with yet another aspect of the invention, a flared annular, preferably elastomeric, seal is placed inside the housing between the housing and the outer surface of the coaxial cable to protect the connector from moisture and particulates.

Other advantageous aspects of the present invention will become apparent to those skilled in the art upon studying the disclosure. All such aspects of the present invention are intended to be covered by the claims.

BRIEF DESCRIPTION OF THE DRAWINGS

FIG. 9 is a cross-sectional view of the portion of the connector assembly of FIG. 5 with a bead ring;

FIG. 10 is a top view of a resilient clamping ring composed of powdered metal segments and an elastic band;

FIG. 11 is a cross-sectional view of the portion of the connector assembly of FIG. 5 with the powdered segmented ring;

FIG. 12 is a side-elevational view of another connector assembly constructed in accordance with the present invention and shown in an open position;

FIG. 13 is a side-elevational view, partially in cross section, of the connector assembly of FIG. 12 taken along the plane of FIG. 12 and showing closing of the locking mechanism;

FIG. 14 is a side-elevational view of a coaxial cable having a helical outer conductor with a garter spring placed in a valley adjacent to the end, in accordance with the present invention;

FIG. 15 is a side-elevational view, partially in cross section of the coaxial cable of FIG. 14 taken along the line 15—15 thereof;

FIG. 16 is a side-elevation, partially in section, of a corrugated elliptical waveguide equipped with a connector assembly embodying the present invention; and FIG. 17 is a section taken generally along line 17—17 in FIG. 16.

DETAILED DESCRIPTION OF THE INVENTION

It has been discovered that uniform, long lasting electrical connections can be efficiently achieved between a coaxial cable having a corrugated outer conductor and a connector, using a connector kit constructed in accordance with the present invention and using a method of attachment of the present invention. To make a connector assembly of the present invention, the corrugated outer connector is cut to define an end surface which is generally perpendicular to the longitudinal axis of the coaxial cable. The end surface intersects a crest of a corrugation of the outer conductor of the coaxial cable at or inward of the apex of the corrugation so as to form a flared end portion. A front connector housing is then placed over the flared end portion and moved inward of the flared end portion. An expandable-retractable clamping ring is then placed in a corrugation valley which is adjacent to the flared end portion. A clamping member is then brought in contact with the front connector. The clamping member has a contact surface which is preferably annular and frusto-conical in shape to substantially conform to the shape of the inside surface of the flared end portion. The clamping member is attached to the front housing. Preferably, the attachment is achieved by threading the clamping member onto the front housing until the annular contact surface is pressing against the inside surface of the flared end portion and the wedging surface of the front housing holds the clamping ring tightly against the outer surface of the flared end portion so as to establish a uniform, lasting electrical connection between the connector and the outer conductor of the coaxial cable.

Figure 8:
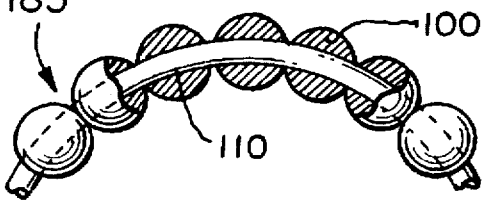
FIG. 8 is a top view, partially in cross-section, of a resilient clamping ring composed of steel beads and an elastic band.

The expandable-retractable ring suitable for use in connection with the present invention can be made of any material that can provide the desired pressure against the flared end portion without breaking or decomposing. Rings suitable for use with the present invention can be made of a conductor or a non-conductor. However, rings made from a metal especially steel, are currently preferred. Any mechanism for expanding and retracting the ring can be employed. However, it is currently preferred to use a steel garter spring. As one alternative, a segmented resilient ring in which metal segments are held together by an elastomeric band can be used. Two alternative embodiments of segmented resilient rings suitable for use in the present invention are shown in FIGS. 8–11. As shown in FIGS. 8 and 9, the segments of the ring can comprise a plurality of discrete beads held together by a band. It is currently preferred to use an elastomeric band, such as, a rubberband to hold the segments together and allow for the expansion when the ring is inserted over the flared portion. As shown in FIGS. 10 and 11 the segments of the ring can fit together to form a substantially continuous structure. The resilient clamping ring of the present invention is preferably hollow. Currently, the most preferred resilient clamping ring is a metal garter spring, and in particular, a steel garter spring. If a conducting garter spring is desired, it is preferably made of a beryllium-copper alloy.

The present invention is applicable to coaxial cables with annular corrugated outside conductors and those with helically corrugated outside conductors. As is well known to those familiar with this art, an "annularly" corrugated conductor is distinguished from a "helically" corrugated conductor in that the annular corrugations form a series of spaced parallel crests which are discontinuous along the length of the cable, and, similarly, a series of spaced parallel valleys which are also discontinuous along the length of the cable. That is, each crest and valley extends around the circumference of the conductor only once, until it meets itself, and does not continue in the longitudinal direction Consequently, any transverse cross-section taken through the conductor perpendicular to its axis is radially symmetrical, which is not true of helically corrugated conductors.

It has also been discovered that connector insert members for the inner conductor can be inexpensively and efficiently manufactured. When a coaxial cable with a hollow inner conductor is used, the connector insert member includes a tubular member which is designed to fit inside the hollow inner connector. The tubular member has a plurality of longitudinal slits extending from the end thereof so that the insert member can be easily inserted into the inner hollow conductor and provide good electrical contact with the inside wall of the inner hollow conductor. The connector insert member includes a ledge on the tubular member, which allows the member to be manually inserted to a precise longitudinal position. The opposite end of the connector insert member includes a tube with a slotted tapered end portion for mating with a corresponding connector fitting. The tapered end portion is machined both on the inside and outside to the desired shape, and a plurality of longitudinal slits is cut in the tapered end portion. The connector insert member of the present invention preferably includes a dielectric member. Preferably, the dielectric member is made of plastic and has bores therethrough to adjust its dielectric constant so that the impedance of the connector matches the impedance of the coaxial cable at the frequencies of interest. Preferably, the plastic member is cylindrical and fits closely inside the clamping member so as to align and provide mechanical stability to the conductor insert member.

DESCRIPTION OF THE PREFERRED EMBODIMENT

Figure 1:
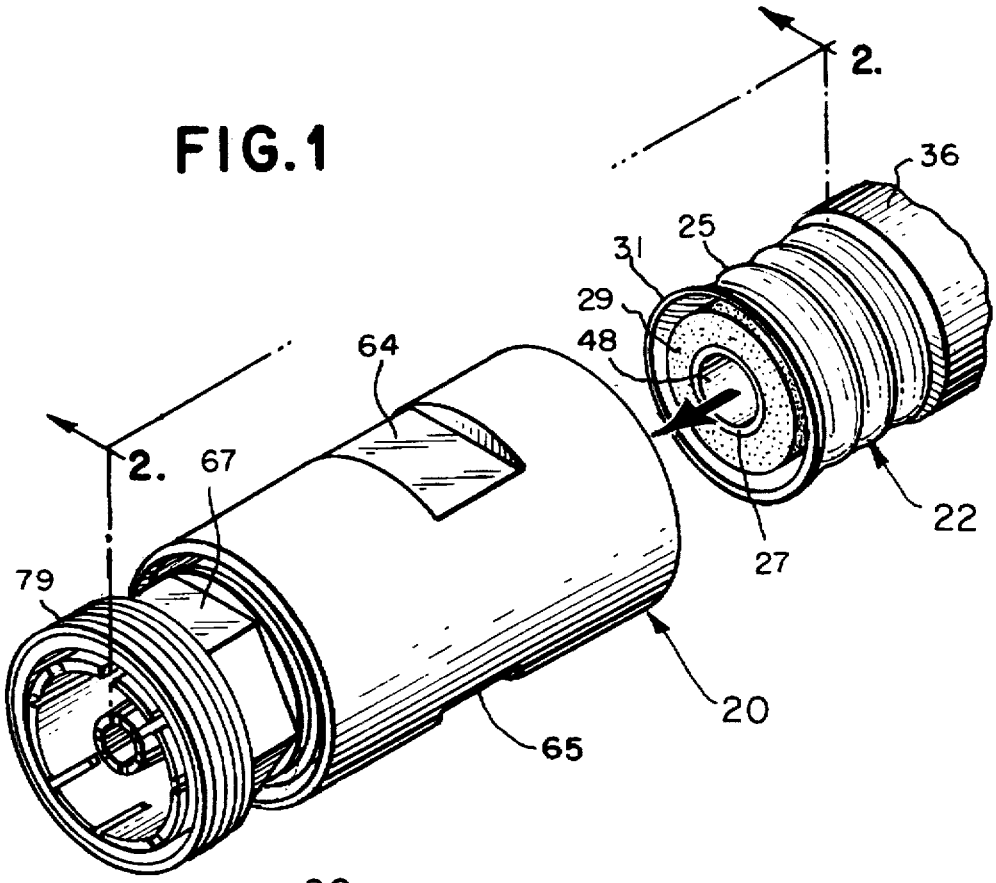
FIG. 1 is a perspective view of a connector constructed in accordance with the present invention and of a corrugated coaxial cable for receiving the connector.

Turning now to the drawings, the preferred embodiment of the present invention is shown in FIGS. 1–7. FIG. 1 depicts a connector 20 for attachment to a coaxial cable 22 having an annularly corrugated outer conductor 25 concentrically spaced from a hollow inner conductor 27 by a foam dielectric 29. As shown in FIG. 1, to prepare the cable 22 for attachment of the connector 20, the end of the cable is cut along a plane extending through the apex of one of the crests of the corrugated outer conductor to produce an end surface perpendicular to the longitudinal axis of the cable 22. The cut produces a flared end portion 31 which includes an inside surface 33 and an outside surface 35. The foam dielectric 29 normally does not fill the crests of the corrugated outer conductor 25, so the inside surface 33 of the flared end portion 31 is exposed. However, if the foam dielectric 29 does fill the flared end portion 31, then a portion of the dielectric 29 should be removed to permit contact with the inside surface 33 of the flared end portion 31. Any burrs or rough edges on the cut ends of the metal conductors are preferably removed to avoid interference with the connector.

The outer surface of the outer conductor 25 is normally covered with a plastic jacket 36 which is trimmed away from the end of the cable 22 along a sufficient length to accommodate the connector 20.

Figure 2:
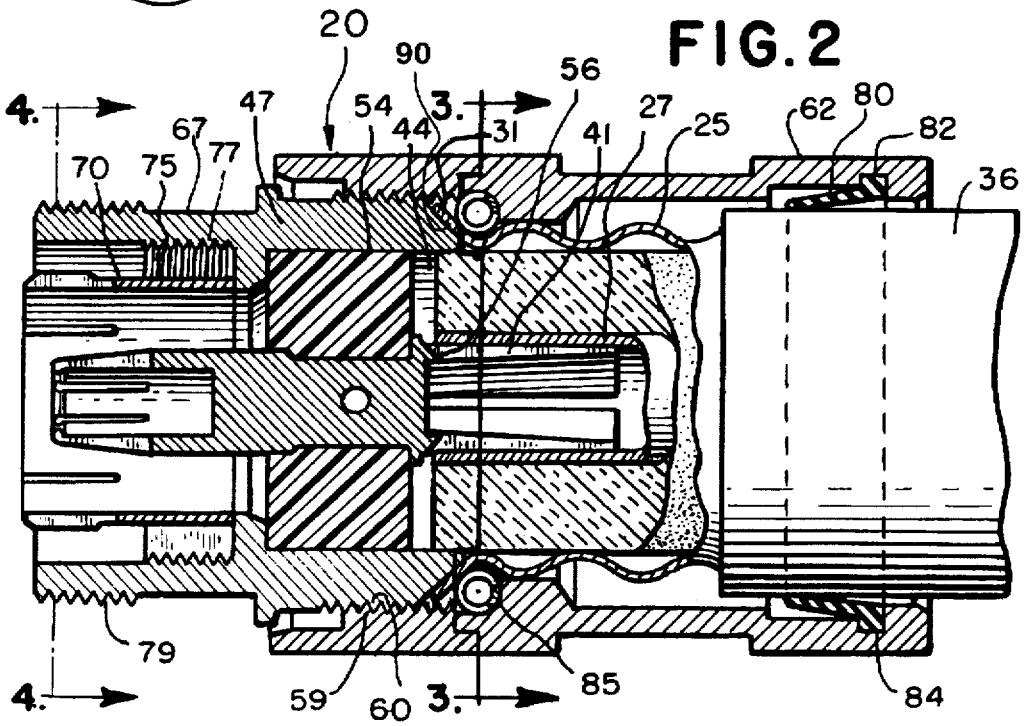
FIG. 2 is a cross-sectional view of the assembled connector and cable of FIG. 1 taken along the line 2—2 thereof.
Figure 6:
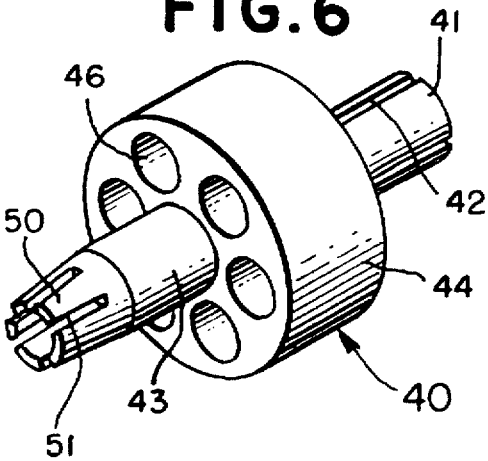
FIG. 6 is a perspective view of an insert member for connecting the hollow inner conductor of the coaxial cable to a fitting.

As shown in FIG. 2, electrical contact of the connector 20 with the inner conductor 27 of the cable 22 is effected by a conductor insert member 40. As shown in FIG. 6, the insert member 40 includes at one end a tubular conductor member 41 designed to fit inside the inner hollow conductor 27 of the coaxial cable 22. As shown in FIG. 2, the member 41 frictionally engages the inside wall 48 of the hollow inner conductor 27. As shown in FIGS. 2 and 6, the member 41 has a plurality of slits 42 which facilitate insertion thereof into the inner hollow conductor 27. At the end opposite to the tubular conductor member 41, the insert member 40 includes a tubular partially tapered connector fitting end 43 designed to fit into a conventional complementary mating connector fitting (not shown). The tapered portion 50 of the fitting end 43 is made by machining both the inside and the outside surfaces of the fitting end 43. Longitudinal slots 51 are cut in the fitting end 43 to facilitate insertion thereof into the corresponding mating connector fitting (not shown). The inside of the fitting end 43 is machined using preferably a flag-like bit to remove the material and to produce a desired internal shape. Since the taper in the tapered portion 50 is machined, the longitudinal slits 51 have uniform widths along their lengths. The insert member 40 also includes a cylindrical plastic centering dielectric member 44. As shown in FIG. 6, the dielectric member 44 contains a plurality of bores 46 therethrough to define its dielectric value. The dielectric member 44 is cylindrical and the outer diameter of the member 44 is set to provide a press-fit with the clamping member 47. Therefore, the member 44 maintains the conductor member 41 and conductor fitting end 43 in axial alignment with the inner conductor 27. As shown in FIG. 2, the tubular conductor member 41 fits tightly against and frictionally engages the inside wall 48 of the inner conductor 27.

The tubular conductor member 41 includes an annular ledge 56 which locates the axial position of the insert member 40. As shown in FIG. 2, the cylindrical plastic centering member 44 fits closely inside the bore 54 in the clamping member 47. The clamping member 47 has outside threads 59 which mate with the inside threads 60 of a front housing 62.

Figure 7:
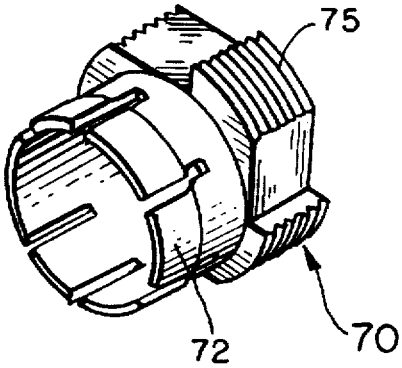
FIG. 7 is a perspective view of an outer connector fitting of the clamping member, designed to mate with the corresponding outer connector fitting on a corresponding mating connector.

As shown in FIG. 1 and FIG. 2, the outside cylindrical surface of the front housing 62 includes two parallel flat surfaces 64 and 65, which accommodate a wrench (not shown) for threading the front housing 62 and the clamping member 47. The clamping member 47 includes an hexagonal portion 67 with six flat sections for accommodating a wrench (not shown). The clamping member 47 also includes an connector fitting 70 which is shown in FIG. 7. The fitting 70 includes a slotted annular mating portion 72 designed to mate with a corresponding part on the mating connector (not shown) and a plurality of aligned threaded portions 75. As shown in FIGS. 1 and 2, the fitting 70 is threaded inside the clamping member 47, the threads of the threaded portion 75 engaging corresponding threads 77 of the clamping member 47. As shown in FIGS. 1 and 2, the clamping member 47 includes on its fitting end, a plurality of threads 79 for connecting the connector 20 to the corresponding mating connector (not shown).

As shown in FIG. 2, the front housing 62 is equipped with a seal 80 made of an elastomeric material. The seal 80 is frictionally attached to the front housing 62 by an annular ridge 82 fitting tightly inside an annular groove 84 in the front housing 62. The seal 80 is flared and forms an outwardly projecting rib on its inner end so that it is compressed between the jacket 36 and the housing 62 to prevent moisture and debris from entering the front housing 62.

Figure 3:
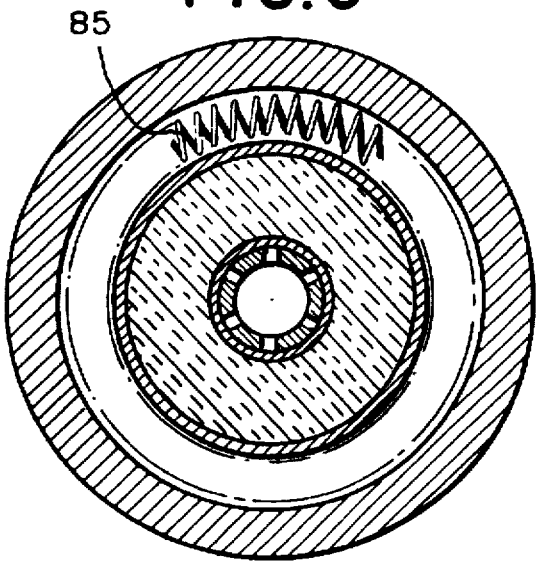
FIG. 3 is a cross-sectional view of the connector assembly of FIG. 2 taken along the line 3—3 thereof.
Figure 4:
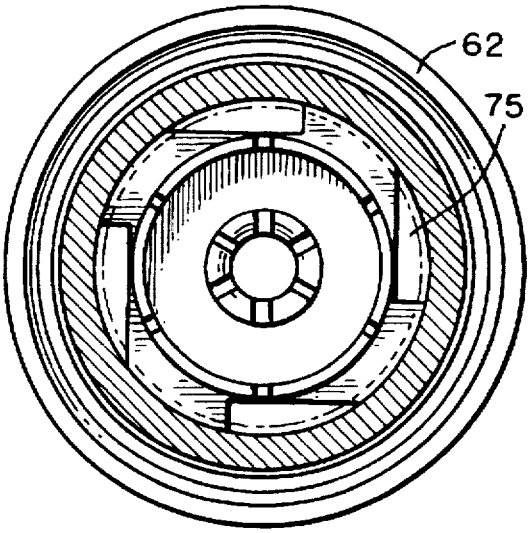
FIG. 4 is a cross-sectional view of the connector assembly of FIG. 2 taken along the line 4—4 thereof.
Figure 5:
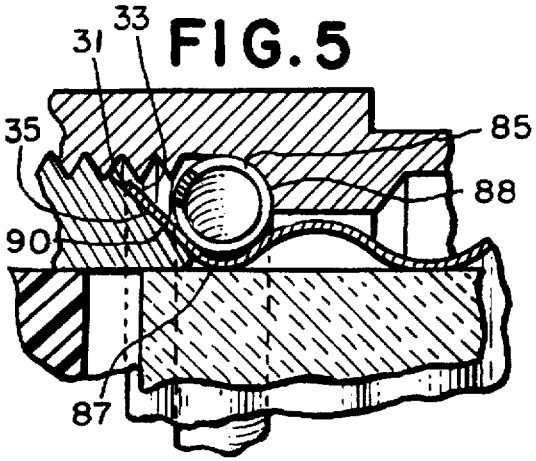
FIG. 5 is an enlarged cross-sectional view of a portion of the connector assembly of FIG. 2.

The electrical contact between the outer conductor 25 and the connector 20 is shown in FIGS. 2, 3 and 5. As shown in those figures, a steel garter spring 85 is located in a corrugation valley 87 adjacent the flared end portion 31. The spring 85 is wedged against the inside surface 33 of the flared end portion 31 by an annular wedging surface 88 located inside the front housing 62. The spring 85 presses on the inside surface 33 so that the outside surface 35 of flared end portion 31 is tightly in contact with an annular frusto-conical contact surface 90 located on the clamping member 47.

To install the connector 20 of the present invention, the coaxial cable is cut across the apex of the corrugation so as to form the flared end portion 31. Then, a sufficient section of plastic jacket 36 is trimmed to expose the outer conductor 25. The front housing 62 is then inserted over the trimmed portion and moved far enough from the flared end 31 to expose the corrugation valley 87.

The garter spring 85 is then manually placed in the corrugation valley 87 as shown in FIGS. 2, 3 and 5. The garter spring of the preferred embodiment is made of stainless steel. The stainless spring wire is 0.020" in diameter. The coils of the spring are ⅛" in diameter and the inner diameter of the spring is 0.840". Next, the clamping member 47 is threaded into the front housing 62, preferably, by using wrenches (not shown) placed on the flats 67 and flat surfaces 64. As shown in FIG. 2, as the clamping member 47 is threaded into the front housing 62, an annular wedging surface 88 forces the garter spring 85 against outside surface 35 of the flared end portion 31. This action forces the flared end 31 tightly against the annular contact surface 90. The tight contact between the annular contact surface 90 and the inside surface 33 of the flared end portion 31 produces good electrical contact.

DESCRIPTION OF OTHER EMBODIMENTS

FIGS. 8 and 9 depict another embodiment of the present invention which differs form the preferred embodiment in that is uses a different clamping ring. The clamping ring in this embodiment includes a plurality of metal, preferably steel, beads 100 held together by an elastomeric material, preferably a rubber band 110, as shown in FIG. 8. The clamping ring 185 is placed in a valley 187 which is adjacent to the flared end portion 131 as shown in FIG. 9. The clamping ring 185 is wedged against the flared end portion 131 to provide a good electrical contact with the annular contact surface 190 as shown in FIG. 9.

FIGS. 10 and 11 depict a further embodiment of the present invention which differs from the preferred embodiment in that it uses a different clamping ring. FIGS. 10 and 11 show a clamping ring 285 which is composed of a plurality of segments 286 which fit together to form a substantially continuous structure. The segments 286 are held together by an elastomeric material 289. The segments 286 are preferably made of a powdered metal. The clamping ring 285 fits in a corrugation valley 287 as shown in FIG. 11. It is wedged against the inside surface 233 of the flared end portion 231 by the annular wedging surface 288 of the front housing 262. The clamping ring 285, in turn, presses the flared end portion 231 against the annular frusto-conical contact surface 290 so that a good electrical contact is achieved between the contact surface 290 and the outside surface 235.

The embodiment of the present invention shown in FIGS. 12 and 13 differs from the preferred embodiment by the present invention in the manner the clamping member is attached to the front housing. As shown in FIGS. 12 and 13, instead of being threaded together, these two parts are held together by a mechanism which allows forming the desired attachment without any tools.

Specifically, referring now to FIG. 12, steel members 300 and 301 fit on one end in the grooves 303 and 304, respectively, of the clamping member 347. A closing bar 305 is operatively connected to the members 300 and 301 as shown in the FIGS. 12 and 13. As shown in FIG. 13, by moving the bar 305 from its open to its closed position (shown in dotted lines in FIG. 13), the mechanism brings the clamping member 347 and the front housing 362 toward each other to a position where the wedging surface of the front housing presses against the clamping member and the clamping member forces contact between the contact surface of the clamping member and the outside surface of the flared end portion.

The embodiment of the present invention shown in FIGS. 14 and 15 differs from the preferred embodiment in that it includes a coaxial cable 436 with an outside conductor 425 having helical rather than annular corrugations. The coaxial cable 436 further includes a foam dielectric 429 and an inner conductor 427. The garter spring 485 fits in a valley 487 as shown in FIGS. 14 and 15.

FIGS. 16 and 17 illustrate a modified embodiment of the invention for use with the helically corrugated elliptical waveguide. A connector housing 500 fits over the stripped end of a helically corrugated elliptical waveguide 501 having a flared end portion 502. The outside cross-section of the housing 500 is circular, while the inside cross-section is elliptical to conform to the shape of the waveguide. A garter spring 503 fits into the corrugation trough immediately adjacent the outer surface of the flared end portion 502 and is captured by the surrounding housing 500. The garter spring 503 easily conforms to the elliptical shape of the waveguide. The inner surface of the flared end portion 502 of the waveguide is engaged by a bevelled end surface 504 on an inner clamping member 505 which telescopes into one end of the housing 500. An O-ring 506 is held in a groove in the outer surface of the clamping member 505, and engages the inside surface of the housing 500 to provide a seal between these two members. Another seal 507 is provided at the opposite end of the housing 500, to form a seal between the housing and the jacket 508 on the outer surface of the waveguide 501.

The connector assembly shown in FIGS. 16 and 17 is held in place on the waveguide by the same type of mechanism described above in connection with FIGS. 12 and 13. That is, a pair of steel rods 509 are pivotally attached to the inner clamping member 505 and extend along opposite sides of the housing 500 for connection to a closing bar 510. Opposite ends of the closing bar 510 are pivotally attached to the housing 500, so that the closing bar can be pivoted onto the waveguide jacket 508 to draw the clamping member 505 firmly against the flared end portion 502 of the waveguide. To release the connector, the closing bar 510 is pivoted outwardly away from the waveguide, thereby releasing the clamping member 505, and thus the housing 500, from the waveguide.

As in most connector assemblies, the shapes and dimensions of the various parts are selected to provide impedance matching between adjoining parts, so that the complete connector and cable assembly has a low VSWR.

While the invention is susceptible to various modifications and alternative forms, a specific embodiment thereof has been shown by way of example in the drawings and been described in detail. It should be understood, however, that it is not intended to limit the invention to the particular form described, but, on the contrary, the intention is to cover all modifications, equivalents, and alternatives falling within the spirit and scope of the invention as defined by the appended claims.

I claim:

1. A connector assembly for engagement with a corresponding mating connector fitting, comprising:

a coaxial cable having a corrugated outer conductor with a plurality of corrugations, each corrugation having a valley between two crests, each crest having an apex, an inner conductor and a dielectric between the outer conductor and the inner conductor, said coaxial cable having one end defined by a cross-sectional end surface, said cross-sectional end surface being substantially perpendicular to the longitudinal axis of the coaxial cable and intersecting said outer conductor at or inward of the apex of a crest and forming an annular flared end portion, said flared end portion having an inside surface and an outside surface;

a front housing having a first end, a second end and a wedging surface, the first end of said housing fitting around the outer conductor;

a connecting insert member having a first end and a second end said first end being electrically connected to the inner conductor and said second end for engagement with the corresponding mating connector fitting;

a clamping member having a contact surface in contact with the inside surface of the flared end portion of said outer conductor and having a connector end for engagement with the corresponding mating connector fitting;

a closed expandable-retractable clamping ring for placement in the valley adjacent to the flared end portion, said ring being pressed by the wedging surface of said front housing against the outside surface of the flared end portion of the outer conductor, said ring being sufficiently rigid to cause, when wedged against the outer surface of the flared end portions, a uniform electrical contact between the inside surface of said flared end portion and said contact surface; and an attachment holding the wedging surface pressed against the clamping ring and the clamping ring wedged against the outside surface of the flared end portion of the outer conductor so as to provide electrical contact between the contact surface and the inside surface of the flared end portion.

2. The connector assembly claimed in claim 1 wherein the clamping ring comprises a segmented resilient ring.

3. The connector assembly claimed in claim 1 wherein the clamping ring comprises a garter spring.

4. The connector assembly claimed in claim 1 wherein the attachment comprises threads in said second end for engaging corresponding threads in the clamping member.

5. The connector assembly claimed in claim 1 wherein the corrugated outer conductor has helical corrugations.

6. The connector assembly claimed in claim 1 further comprising an annular seal extending between coaxial cable and the first end for shielding the electrical connection between the inside wall of the flared end portion and the contact surface of the clamping member.

7. The connector assembly claimed in claim 3 wherein the spring is made of metal.

8. The connector assembly claimed in claim 7 wherein the spring is made of steel.

9. The connector assembly claimed in claim 7 wherein the spring is made of beryllium-copper alloy.

10. The connector assembly claimed in claim 1 wherein said clamping member has a bore therethrough the bore defining an inner wall and further comprising a cylindrical dielectric member centrally located on the connecting insert member, said dielectric member fitting closely against the inner wall of the bore in said clamping member.

11. The connector assembly claimed in claim 10 wherein the cylindrical dielectric member is made of plastic.

12. The connector assembly claimed in claim 11 wherein the cylindrical dielectric member has plurality of bores therethrough so as to match the impedance of the connector assembly at the frequency of interest to that of the coaxial cable.

13. The connector assembly claimed in claim 1 wherein the attachment comprises a clamping mechanism.

14. The connector assembly claimed in claim 13 wherein the clamping mechanism comprises a plurality of cooperating clamping members pivotally attached to the front housing and on the clamping member.

15. The connector assembly claimed in claim 1 wherein the corrugated outer conductor has annular corrugations.

16. The connector assembly claimed in claim 1 wherein the inner conductor is a hollow conductor having an inside wall and the first end frictionally engages the inside wall.

17. The connector assembly claimed in claim 16 wherein the second end is tubular and has a plurality of longitudinal slits.

18. The connector assembly claimed in claim 15 wherein the contact surface of the clamping member is annular and the wedging surface of said front housing is annular.

19. The connector assembly claimed in claim 18 wherein the contact surface of the clamping member is frusto-conical.

20. A method for attaching a connector having a front housing to a coaxial cable having an outer corrugated conductor with a plurality of corrugations, each including a crest and a valley, each crest having an apex, and an inner conductor, said method comprising the following steps:

cutting the outer conductor of the coaxial cable at or inward of an apex of a crest to form a flared end portion, the flared end portion having an inside surface and outside surface, and to produce an end surface substantially perpendicular to the longitudinal axis of the coaxial cable;

inserting the front housing over the end of the outer conductor and moving the front housing inward past the valley adjacent to the end surface of the outer conductor;

placing a closed expandable-retractable clamping ring in the valley adjacent to the end surface of the outer conductor;

placing an insert connector member, adapted to mate with a corresponding inner conductor connector, in electrical contact with the inner conductor of the coaxial cable;

placing a contact surface of a clamping member, having a portion adapted to mate with a corresponding outer conductor connector, against the inside surface of the flared end portion;

clamping said front housing to said clamping member to tightly wedge the clamping ring against the outer surface of said flared end portion to achieve a uniform electrical contact between the inside surface of the flared end portion and the contact surface of the clamping member.

21. The method of claim 20 wherein the corrugations are annular and the cutting produces a flared end portion having a substantially frusto-conical inside surface.

22. The method of claim 20 wherein the corrugations are helical.

23. The method of claim 20 wherein the expandable-retractable clamping ring is a segmented resilient ring and it is manually expanded to fit over the flared end portion and then allowed to retract into the valley adjacent to the end surface of the outer conductor.

24. The method of claim 20 wherein the expandable-retractable clamping ring is a garter spring and is manually expanded to fit over the flared end portion and then allowed to retract into the valley adjacent to the end surface of the outer conductor.

25. The method claimed in claim 20 wherein the inner conductor is a hollow conductor having an inner wall and wherein the first end of the connector insert member is placed inside the inner wall to frictionally engage said inner wall.

26. A connector kit for attachment to a coaxial cable for mating with a connector fitting having a corresponding mating inner connector fitting and a corresponding mating outer connector fitting, said coaxial cable having a corrugated outer conductor with a plurality of corrugations, each including a crest and a valley, each crest having an apex, an inner conductor and a dielectric between the outer conductor and the inner conductor, said coaxial cable having one end with an end cross-sectional surface traversing the outer conductor, said surface being substantially perpendicular to the longitudinal axis of the coaxial cable and intersecting said outer conductor at or inward of an apex of a crest so as to define and annular flared end portion, said flared end portion having an inside surface and an outside surface, said kit comprising:

a front housing having a first end, a second end and a wedging surface, the first end of said housing adapted to fit around the outer conductor;

an inner conductor connector member having a conductor end for engaging the inner conductor and a connector end for engagement with the corresponding mating inner connector fitting;

a clamping member having a contact surface for contacting the inside surface of said outer conductor and having a connector portion engagement with the corresponding mating outer connector fitting;

a closed expandable-retractable clamping ring for placement in a valley adjacent to said flared end portion and adapted to be wedged between the wedging surface of said housing and the outside surface of the flared end portion of the outer conductor; said ring being sufficiently rigid to cause a uniform electrical contact between said flared end portion and said contact surface and an outer surface; and an attachment for holding the clamping ring wedged against the outside surface of the flared portion of the outer conductor so as to provide electrical contact between the inside surface of the flared end portion and the contact surface.

27. The connector kit claimed in claim 26 wherein the clamping ring is a segmented resilient ring.

28. The connector kit claimed in claim 26 wherein the attachment comprises inner threads in said second end and outer threads in the clamping member corresponding to said inner threads.

29. The connector kit claimed in claim 26 wherein said clamping member has a bore therethrough and further comprising a cylindrical dielectric member attached to said inner conductor member, fitting closely against the inner walls of the bore of said clamping member.

30. The connector kit claimed in claim 26 wherein the corrugated outer conductor has helical corrugations.

31. The connector kit claimed in claim 26 wherein the clamping ring is a garter spring.

32. The connector kit claimed in claim 31 wherein the garter spring is made of metal.

33. The connector kit claimed in claim 31 wherein the garter spring is made of steel.

34. The connector kit claimed in claim 31 wherein the garter spring is made of beryllium-copper alloy.

35. The connector kit claimed in claim 34 wherein the corrugated outer conductor has annular corrugations.

36. The connector kit claimed in claim 26 wherein the cylindrical dielectric member is made of plastic.

37. The connector kit claimed in claim 36 wherein the member includes a plurality of bores therethrough to define the dielectric value of the dielectric member so as to match the impedance of the connector to the impedance of the coaxial cable at the frequencies of interest.

38. The connector kit claimed in claim 26 wherein the attachment comprises a clamping mechanism.

39. The connector kit claimed in claim 38 wherein the clamping mechanism comprises a plurality of posts and corresponding clamping members and bars located on the front housing and on the clamping member.

40. A connector assembly for engagement with a corresponding mating connector fitting, comprising:

a coaxial cable having an outer conductor with annular corrugations each corrugation having a crest and a valley, each crest having an apex, an inner conductor and a dielectric between the outer conductor and the inner conductor, said coaxial cable having a cable end defined by a cross-sectional surface intersecting the outer conductor, said surface being substantially perpendicular to the longitudinal axis of the coaxial cable and intersecting a crest at an apex or inward of the apex to form a flared portion, said flared portion having an inside surface;

a front housing having a first end, a second end and a wedging surface, the first end of said housing fitting around the outer conductor, the second end having a threaded bore therethrough;

a connecting member having a first end and a second end, the first end engaging the inner conductor and the second end being adapted to engage the corresponding mating inner connector fitting;

a clamping member having a contact surface in contact with the inside surface of the flared portion of said outer conductor and having a threaded portion engaging the threaded bore of the second end;

a garter spring in the valley adjacent to the cable end, said spring being wedged by the annular wedging surface of said housing against the outside surface of the flared portion of the outer conductor so that the inside surface of the flared portion is maintained in contact with the contact surface of the clamping member, said ring being sufficiently rigid to cause, when wedged against the outer surface of said flared portion, a uniform electrical contact between the inside surface of said flared portion and said contact surface.

41. The connector assembly claimed in claim 40 wherein the spring is made of metal.

42. The connector assembly claimed in claim 40 wherein the spring is made of stainless steel.

43. The connector assembly claimed in claim 40 wherein the spring is made of beryllium-copper alloy.

44. The connector assembly claimed in claim 40 wherein the inner conductor is a hollow conductor having an inside wall and wherein the first end of the connecting member comprises a tubular member with longitudinal slits, said tubular member frictionally engaging the inside wall of said inner conductor.

45. The connector assembly claimed in claim 40 wherein the corrugations are helical.

46. The connector assembly claimed in claim 40 wherein said clamping member has a bore therethrough and further comprising a cylindrical dielectric member attached to said connecting member and fitting closely against the inner walls of the bore in said clamping member.

47. The connector assembly claimed in claim 46 wherein the cylindrical dielectric member is made of plastic.

48. The connector assembly claimed in claim 46 wherein the cylindrical dielectric member has plurality of bores therethrough to define the dielectric value of the dielectric member so as to match the impedance of the connector to the impedance of the coaxial cable at the frequencies of interests.

49. The connector assembly claimed in claim 40 wherein the corrugations are annular.

50. The connector assembly claimed in claim 49 wherein the wedging surface is annular.

51. The connector assembly claimed in claim 50 wherein the clamping surface is annular.

52. The connector assembly claimed in claim 51 wherein the clamping surface is frusto-conical.

53. A connector assembly for engagement with a corresponding mating connector fitting, comprising:

a corrugated waveguide with a plurality of corrugations, each corrugation having a valley between two crests, each crest having an apex, said waveguide having one end defined by a cross-sectional end surface, said cross-sectional end surface being substantially perpendicular to the longitudinal axis of the waveguide and intersecting at or inward of the apex of a crest and forming an annular flared end portion, said flared end portion having an inside surface and an outside surface;

a front housing having a first end, a second end and a wedging surface, the first end of said housing fitting around the waveguide;

a clamping member having a contact surface in contact with the inside surface of the flared end portion of said waveguide and having a connector end for engagement with the corresponding mating connector fitting;

a closed expandable-retractable clamping ring in the valley adjacent to the flared end portion and pressed by the wedging surface of said front housing against the outside surface of the flared end portion of the waveguide; and an attachment holding the annular wedging surface pressed against the clamping ring and the clamping ring wedged against the outside surface of the flared end portion of the waveguide so as to provide electrical contact between the contact surface and the inside surface of the flared end portion.

54. The connector assembly claimed in claim 53 wherein the corrugated waveguide has an elliptical transverse cross section.

55. The connector assembly claimed in claim 53 wherein the corrugations in the waveguide are helical.

56. The connector assembly claimed in claim 53 wherein the clamping ring comprises a garter spring.

* * * * *